United States Patent [19]

Nissen et al.

[11] 4,083,104

[45] Apr. 11, 1978

[54] RAZOR HANDLE

[75] Inventors: Warren I. Nissen, Topsfield; Roger L. Perry, Lynnfield, both of Mass.

[73] Assignee: The Gillette Company, Boston, Mass.

[21] Appl. No.: 576,254

[22] Filed: May 12, 1975

[51] Int. Cl.[2] ..... B26B 21/22

[52] U.S. Cl. ..... 30/47; 30/89

[58] Field of Search ..... 30/47, 51, 57, 85, 87, 30/89

[56] References Cited

U.S. PATENT DOCUMENTS

| | | | |
|---|---|---|---|
| 978,705 | 12/1910 | Dannacher | 30/51 |
| 1,403,936 | 1/1922 | Behrman | 30/57 |
| 1,441,016 | 1/1923 | Matthews | 30/50 |
| 1,961,236 | 6/1934 | Merrick | 30/85 X |
| 2,685,733 | 8/1954 | Carter | 30/85 X |
| 3,317,995 | 5/1967 | Bord | 30/87 |
| 3,593,416 | 7/1971 | Edson | 30/57 X |
| 3,810,305 | 4/1972 | Perry | 30/47 |
| 3,935,639 | 2/1976 | Terry | 30/47 |
| 3,938,247 | 2/1976 | Carbonell | 30/47 |
| 3,950,849 | 4/1976 | Perry | 30/47 |
| 3,975,820 | 8/1976 | Torance | 30/47 |

FOREIGN PATENT DOCUMENTS

| | | | |
|---|---|---|---|
| 315,580 | 7/1929 | United Kingdom | 30/47 |

*Primary Examiner*—Gary L. Smith

*Attorney, Agent, or Firm*—Richard A. Wise; Oistein J. Bratlie; Donald E. Mahoney

[57] ABSTRACT

A razor handle for a razor blade assembly adapted to be movably mounted on the handle and having cam means thereon for receiving a biasing force, the razor handle having movable arms with journal means providing an axis about which the razor blade assembly may be pivoted, and cam follower means adapted to engage the cam means on the razor blade assembly for exerting a bias force thereon.

7 Claims, 14 Drawing Figures

18
14
34
16
15
12
32
13

10
9
37
38
38a
36
30
31
73
23
50
21
52
22
54
35
29
25
27
26
19
17
33
24
62
60
120
72
70
42
40
7
28

Fig. 7
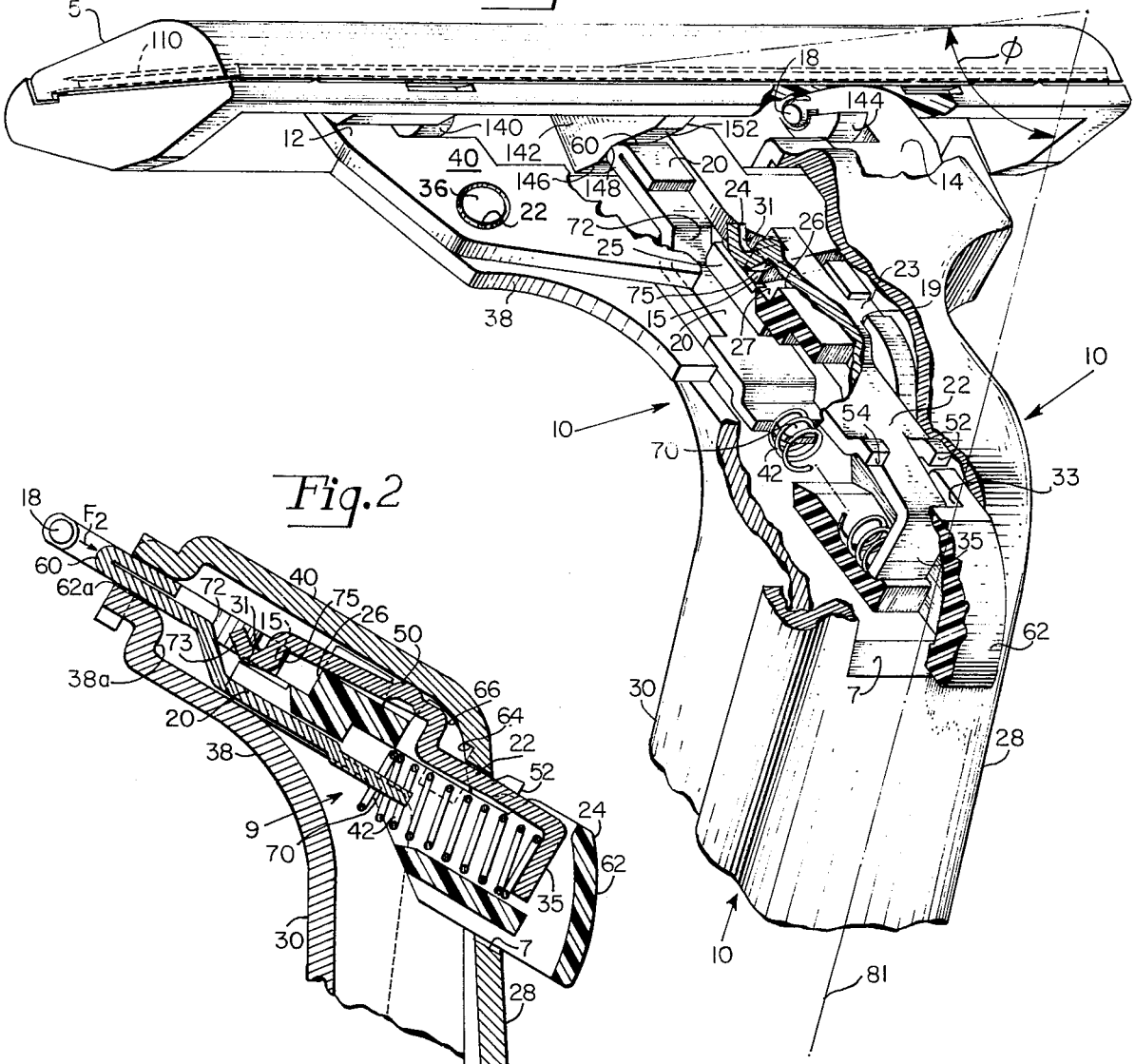
Fig. 2
Fig. 3
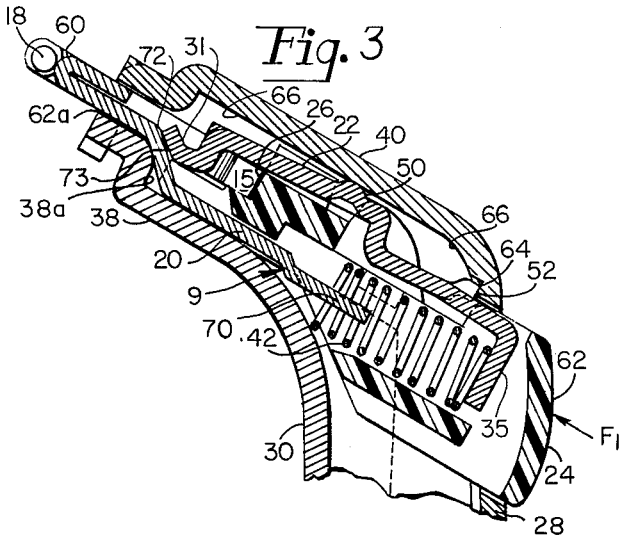

Fig. 8
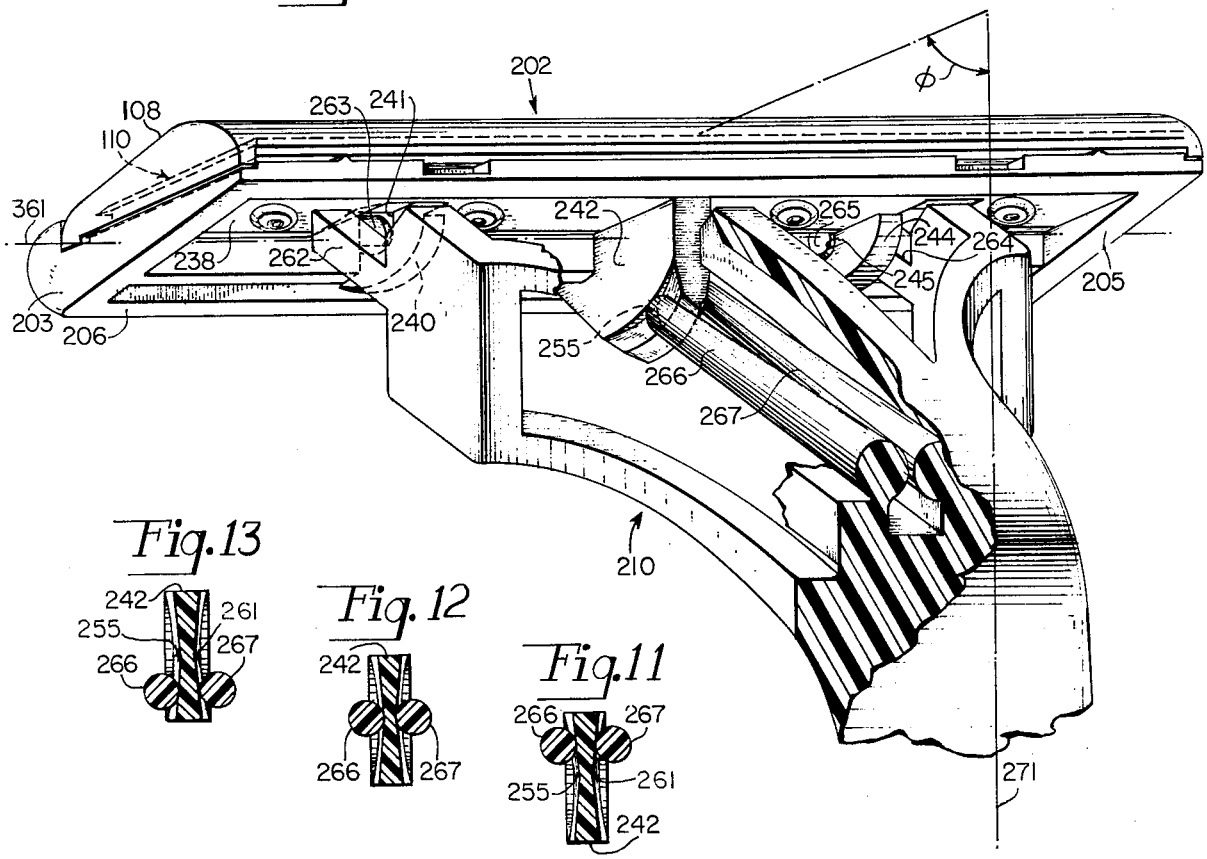
Fig. 13
Fig. 12
Fig. 11
Fig. 9
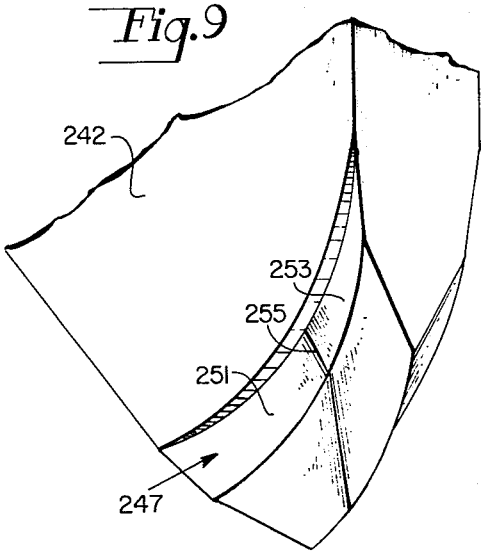
Fig. 10
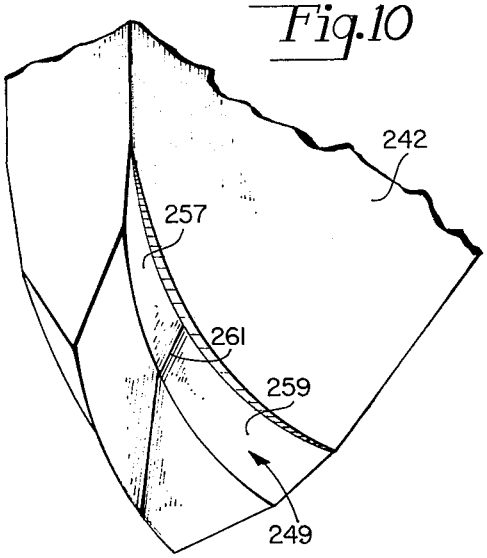

RAZOR HANDLE

BACKGROUND OF THE INVENTION

1. Field of the Invention

This invention relates to wet shaving systems and, more particularly, to a razor handle adapted to be pivotally connected to a razor blade assembly in which a razor blade is secured in a permanent manner to a substantially rigid member, the substantially rigid member having a cam for receiving a biasing force exerted by the razor handle.

2. Description of the Prior Art

Safety razors conventionally comprise a guard member and a cap member between which, in use, a disposable razor blade is sandwiched, and a handle—the guard member, the cap member, and the handle—being fixed relative to one another. The latter feature is present in the conventional one-piece and three-piece razors designed to take disposable, double-edged blades. Safety razors have recently appeared on the market which comprise, instead of disposable razor blades, a disposable razor blade assembly, or head, having a guard member, one or more blades, and a cap member held rigidly together. The disposable razor blade assembly is rigidly attached to a handle so that the razor edges are at a fixed angular attitude relative to the handle. The blade assembly is replaced as a whole when the razor cutting edge (or edges) becomes blunt.

Continuing efforts are being made to improve the shaving characteristics of such implements and/or to accommodate individual preferences. A factor in shaving efficiency and effectiveness is the orientation of the active components of the shaving system relative to the skin surface being shaved. The surface frequently has undulations or is in a relatively inaccessible or awkward area to reach and the shaving action is reduced in efficiency because the relationship of the active element to the skin surface being shaved significantly departs from the optimum value. Razors in which there is a fixed realtionship between the shaving unit and the razor handle call for considerable dexterity on the part of the user and substantial changes in the disposition of the handle in order to maintain the shaving unit at its optimum attitude on the shaver's face, particularly when negotiating areas, such as the jaw line, where there are gross changes in facial contours.

It has been proposed, for example in U.S. Pat. No. 3,593,416, to improve the shaving characteristics of razors by providing a razor handle with a yoke structure and a blade assembly with pins projecting outwardly from opposite ends of the blade assembly. The pins of the blade assembly are received in the handle yoke structure so that the blade assembly may rock relative to the handle. Such proposed arrangement has certain drawbacks and disadvantages, including cumbersome lengthening of the razor yoke structure beyond the ends of the blade assembly.

SUMMARY OF THE INVENTION

An object of the present invention is to provide a razor handle for a razor blade assembly adapted to be movably mounted on the handle and having cam means thereon for receiving a biasing force, the razor handle comprising journal means formed on movable arm portions of the razor handle for receiving the razor blade assembly, and cam follower means adapted to engage the cam means on the razor blade assembly for exerting a biasing force thereon.

BRIEF DESCRIPTION OF THE DRAWINGS

FIGS. 2 and 3 are center-line, cross-sectional views of a side elevation of the razor handle assembly shown in FIG. 1.

FIG. 7 is a perspective view, partially cut-away of the razor handle assembly, shown in FIG. 1, attached to the razor blade assembly, shown in FIG. 6.

FIG. 8 is a perspective view, partially cut-away, of another embodiment of a razor handle assembly, shown attached to a razor blade assembly.

FIGS. 9 and 10 are isometric drawings of a cam member portion of the razor handle assembly of Fig. 8.

FIGS. 11, 12, and 13 are cross-sectional drawings of a cam member portion of the razor handle assembly of FIG. 8.

DESCRIPTION OF THE PREFERRED EMBODIMENT

Figure 1:
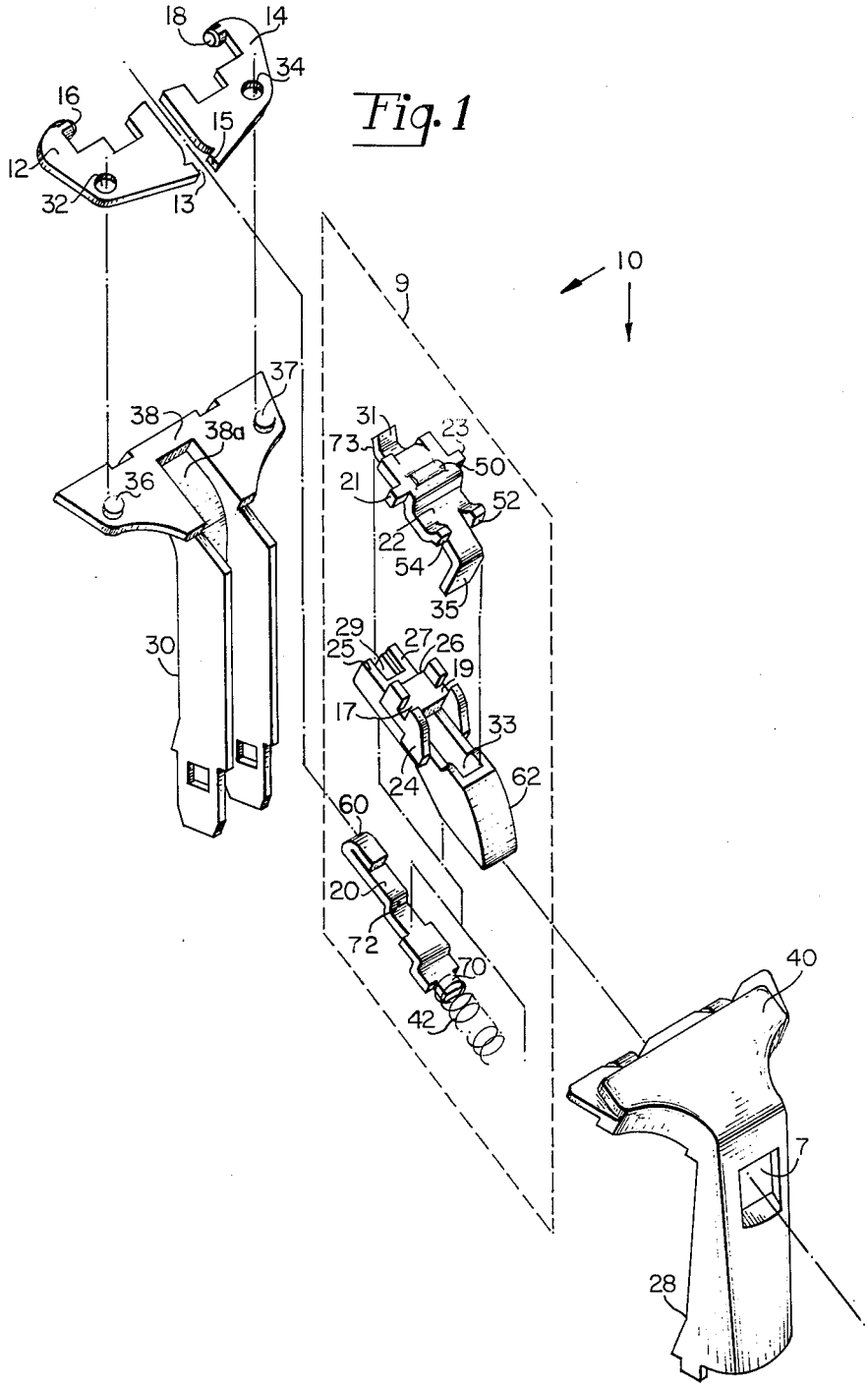
FIG. 1 is an exploded view of one form of razor handle assembly illustrative of an embodiment of the invention.

Referring to FIG. 1, there is shown an exploded view of a razor handle assembly 10 comprising a first handle portion 28 with an aperture 7 therein, a second handle portion 30 arranged, in cooperation with the handle portion 28 to provide a housing for movable arms, 12 and 14, and a cam follower assembly 9 comprising a substantially rigid cam follower member 20, a locking member 22 and a pusher member 24. The pivotally movable arms 12 and 14 are provided with opposing journals 16 and 18 and are arranged to project from the razor handle assembly 10. Means for facilitating the desired pivotal movement of the arms 12 and 14 include cylindrical journals 36 and 37 on a top portion 38 of the handle portion 30 and a journal bearing or aperture 34 in the arm 14 and a journal bearing or aperture 32 in the arm 12. The arms 12 and 14 are disposed between the top portion 38 of the handle portion 30 and a top portion 40 of the handle portion 28 so that the journal 36 is received in the aperture 32 and the journal 37 is received in the aperture 34, whereby the arms 12 and 14, having the journals 16 and 18 thereon, are free to pivotally move about the journals 36 and 37.

Referring to FIGS. 1 and 7, the pusher member 24, locking member 22, and cam follower member 20 are arranged to form the cam follower assembly 9 for pivotally moving the arms 12 and 14 about the journals 36 and 37 when an end 13 of the arm 12 is disposed over a pusher surface 25 and an end 15 of the arm 14 is disposed over a pusher surface 27. The pusher member 24 has slots 17 and 19 for receiving ears 21 and 23 formed on the locking member 22 and an aperture 29 for receiving a curved portion 31 of the locking member 22 and an aperture 33 for receving a downwardly projecting rear portion 35 of the locking member 22. The locking member 22 is formed to have a raised surface 50 and projections 52 and 54. A spring member 42 is coupled between a cam follower end tab 70 and the locking member end 35 to provide a desired bias force to urge a cam follower end 60 against a cam means 146 on a razor blade assembly 5, for exerting a biasing force thereon.

Referring to FIGS. 2 and 3, there is shown a cross-section of a side elevation view taken along a median of the razor handle assembly 10. The cam follower assembly 9 is disposed between a recessed portion 38*a* of the handle portion 30 and the top portion 40 of the handle portion 28. The spring member 42 is compressed between the tab 70 and the rear portion 35 to urge the locking member 22 and through the ears 21, 23 the pusher member 24 rearwardly to cause the pusher end 62 to project from the aperture 7 in the handle portion 28 and a cam follower end 60 to project from an opening 62*a* formed between the handle portions 38 and 40.

Figure 4:
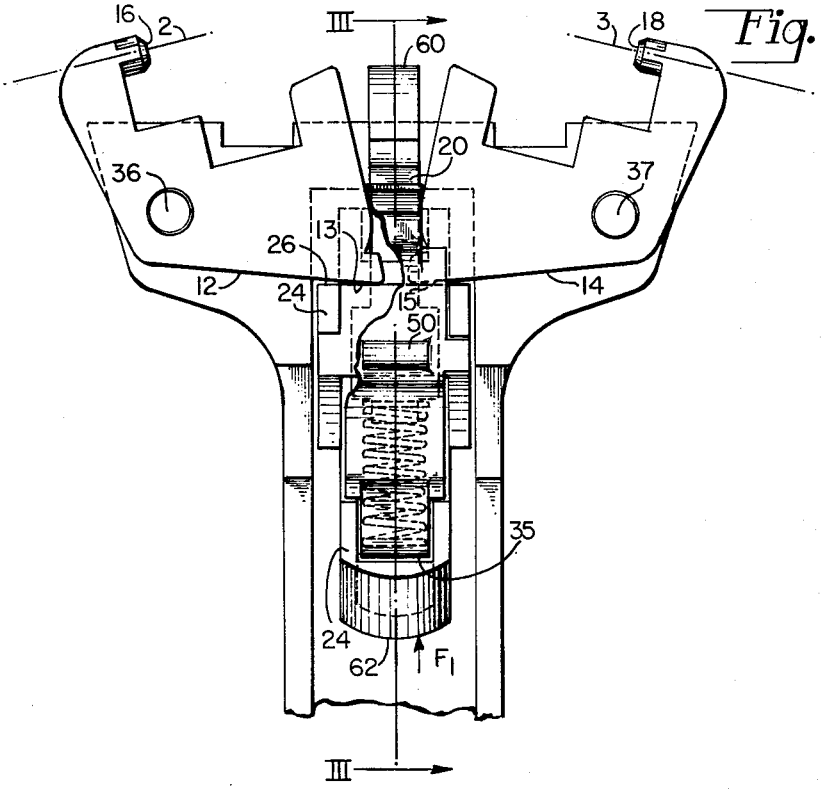

To attach a blade assembly 5 (FIG. 6) to the razor handle 10, a pusher member front surface 26 is urged foward against the arm ends 13 and 15 in response to manual pressure or force, $F_1$ (FIG. 3), applied against the pusher end 62. The forward movement of the pusher member 24 causes the locking member portion 31 to move forwardly from between the arm ends 13 and 15 permitting the pivotal movement of the arms 12 and 14 about the journals 36 and 37 in response to the surface 26 acting against the arm ends 13 and 15. The arms 12 and 14 are moved into an open position (FIG. 4) in which a longitudinal axis 2 of the journal 16 is not parallel to the longitudinal axis 3 of the journal 18. The journals 16 and 18 are locked in the open position when the locking member projections 52 and 54 are received in a notch 64 (FIG. 3) in an inner wall 66 of the top portion 40 of the handle portion 28.

Figure 5:
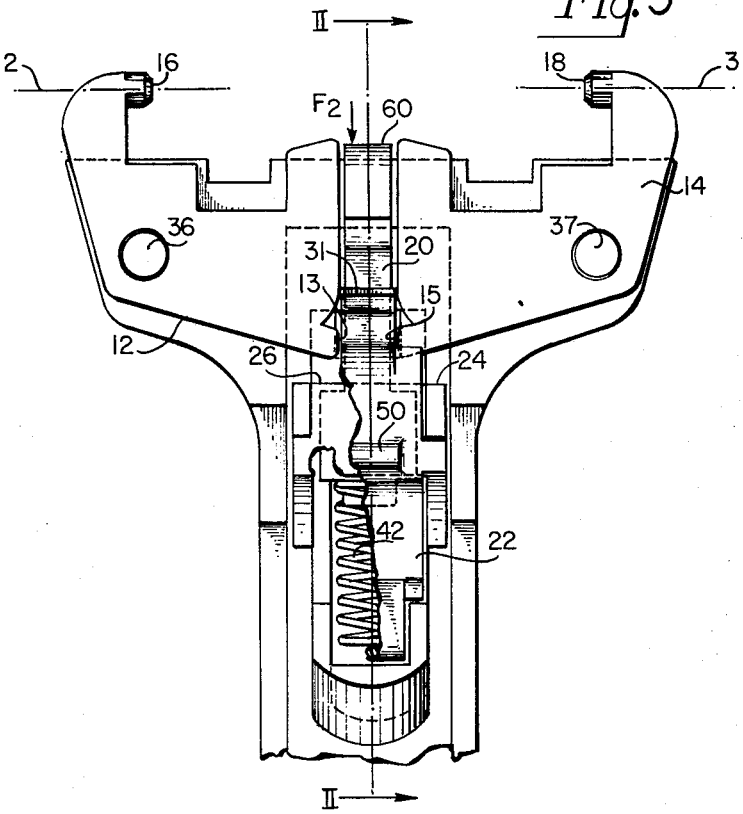
FIGS. 4 and 5 are top views, partially cut-away, of the razor handle assembly shown in FIG. 1.

To close the arms 12, 14 to attach thereto a new razor blade assembly 5, a force, $F_2$ (FIG. 2), is applied to the cam follower end 60 by pressing the cam follower end 60 against the cam means 146 of the razor blade assembly 5. The force $F_2$ is sufficient to compress the spring member 42 and move a cam follower inclined portion 72 against a surface 73 of the locking member front portion 31 (FIG. 3) causing the locking member 22 to pivotally move about the locking member raised portion 50. The locking member front portion 31 is pivotally moved toward the inner surface 66 of the top portion 40 and the projections 52 and 54 are pivotally moved from the notch 64, whereby the compressed spring member 42 is released to provide sufficient bias force to move the locking member 22 rearward in the direction of the applied force, $F_2$, and a surface 75 (FIGS. 2, 3, 7) of the portion 31 against the arm ends 13 and 15. The rearward movement of the locking member 22 causes the arms 12 and 14 to pivotally move about the journals 36 and 37 into an closed position (FIG. 5) in which the longitudinal axes 2 and 3, of the journals 16 and 18, respectively, are aligned substantially transverse to the direction of the force $F_2$. In the closed position, arm ends 13 and 15 abut the portion 31 of the locking member 24 (FIGS. 5 and 7) to prevent motion of the arms 12 and 14 until the force $F_1$ is applied to the pusher end 62, as described above. In both the open and closed positions of the arms 12 and 14, the cam follower member 20 is free to move along a substantially linear path to compress the spring member 42 to permit expansion thereof.

Figure 6:
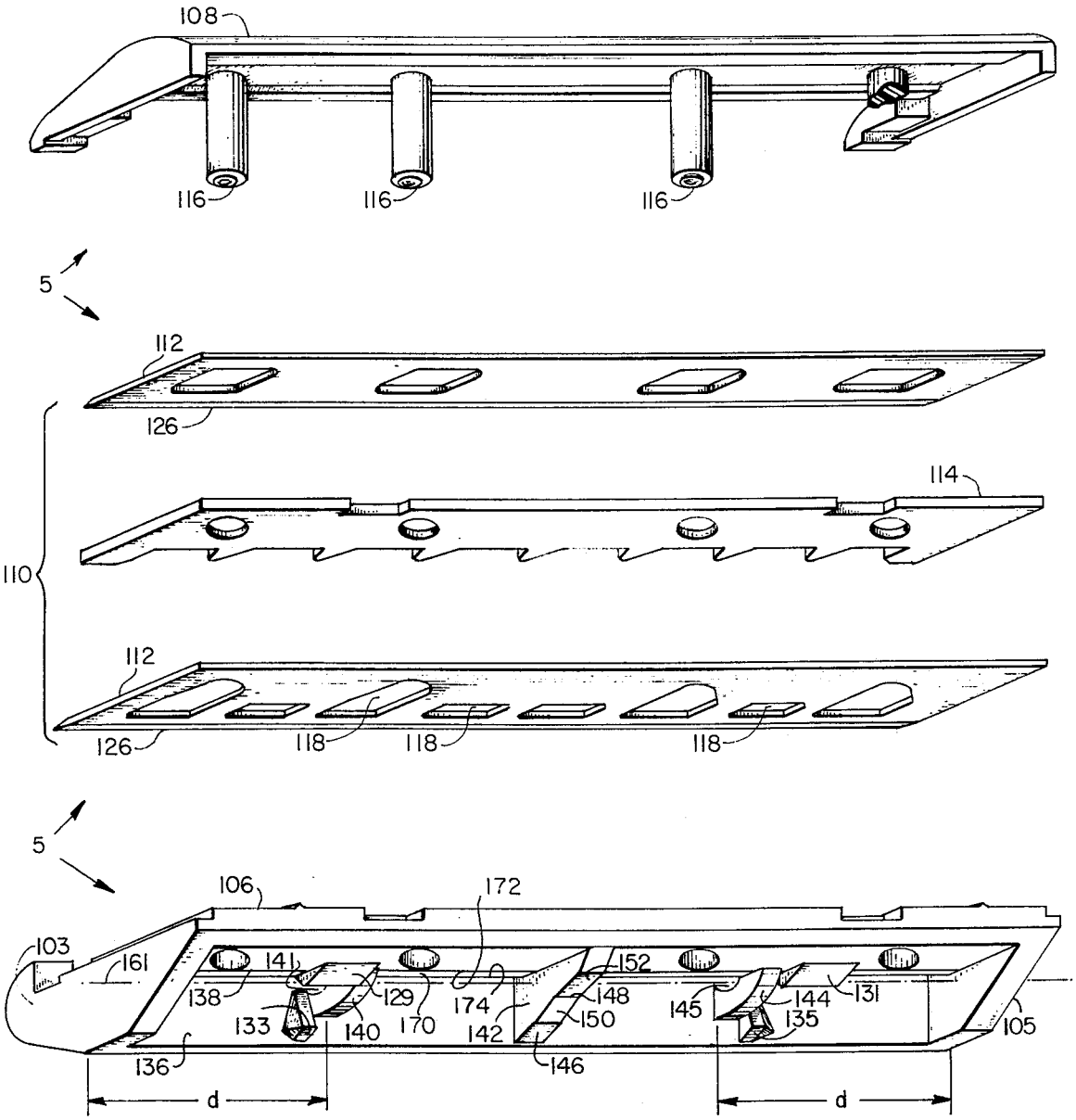
FIG. 6 is an exploded view of a razor blade assembly suitable for use with the illustrative razor handle.

Referring to FIG. 6, it will be seen that the illustrative razor blade assembly 5 includes a substantially rigid platform member 106, a cap member 108, and a blade means 110 comprising one or more blade members 112. When the blade means 110 comprises more than one blade member 112, there may be included in the razor blade assembly 5, a spacer means 114 sandwiched between the two blade members 112, which in turn are sandwiched between the platform member 106 and the cap member 108. One or the other of the cap and platform member has posts 116 which are extended through openings of the razor blade assembly 5 and expanded rivet-like to permanently secure the various parts together. The blade means 110 and the platform 106 may be provided with passages 118 through which shaving debris may flow.

The platform 106 in the illustrative embodiment includes a support member 136 extending between platform ends 103 and 105. The member 106 is further provided with support member 140 and 144 and a cam member 142 attached to the support member 136 and the platform underside 138 in substantially parallel planes generally transverse to the plane of the platform underside 138. Razor blade assembly stop members 129 and 131 extend from the platform underside 138 and razor blade assembly stop members 133 and 135 extend from the support member 136 to limit angular movement of the razor blade assembly 5 when attached to the razor handle assembly 10, as shown in FIG. 7 and described above. The support members 140, 144 and cam member 142 are preferably molded integrally with the platform member 106 and span a gap 170 disposed between a forward edge 172 of the platform underside 138 and an upper edge 174 of the support member 136. The support members 140 and 144 are each located a distance, *d*, from the platform ends 103 and 105, respectively, and the cam member 142 is centrally located between the support members 140 and 144. Unlike prior art razor blade shaving units, such as described in U.S. Pat. No. 3,724,070, the support members 140 and 144 have apertures 141 and 145 therein which in combination with a surface of the blade 112, disposed over the gap 170, comprise journal bearings for the reception of the journals 16 and 18 formed on the movable arms 12 and 14 of the razor handle assembly 10. The journal bearings 141, 145 have axes aligned with each other to provide a pivot axis 161 substantially parallel to razor edges 126. In addition, the cam member 142 is arranged to have an angular-shaped cam surface 146 formed by oppositely inclined flat surface 150 and 152 which intersect to form a dihedral angle with an apex 148. As described below, the cam member 142 is arranged to cooperate with the cam follower member 20 to provide a safety razor which dynamically follows the skin contours and convolutions in the area being shaved.

Referring again to FIG. 7, there is shown a perspective, partially cut-away view of a portion of the razor handle assembly 10 attached to the razor blade assembly 5 so that the blade members 112, shown in FIG. 6, dynamically follow the contours of the area being shaved. The razor blade assembly 5 is attached to the razor by applying a force, $F_1$, to the pusher end 62 to pivotally move and lock the arms 12 and 14 in an open position, as described above. The cam follower end 60 is then urged against the cam member 142 to provide sufficient force, $F_2$, to disengage the locking member projections 52, 54 from the notch 64 and pivotally move the journals 16 and 18 into the journal bearings 141 and 145 on the platform 106. The spring 42 urges the end 60 of the cam follower member 20 against the cam member 142, and urges the cam member 142, and thereby the blade assembly 5 into position such that the cam follower end 60 is disposed at the apex 148. The axes of the journal bearings 141 and 145 are aligned with each other so that the razor blade assembly 5 may be pivoted upon the journals 16 and 18.

The cam surfaces 150 and 152 are inclined at predetermined angles relative to the plane of the platform underside 138 so that the cam member 142 normally engages the cam follower member 20 substantially at the apex 148 to cooperatively urge the blade means 110 in the razor blade assembly 5 to be in a plane at a desired angular attitude, $\phi$, (FIG. 7) relative to the razor longitudinal axis 81, for comfortable and efficient shaving. As the safety razor is moved along a skin surface, skin contours and convolutions act on the razor blade assembly 5 to generate a torque producing force which pivotally moves the razor blade assembly 5 about an axis 161 (FIG. 6) causing the end 60 of the cam follower member 20 to move along the cam surface 146. The pivotal movement of the razor blade assembly 5 causes the cam follower member 20 to move along a substantially linear path within the razor 10 to further compress the spring 42 and to generate a torque producing force for restoring the razor blade assembly 5 to its initial position. The load rate of the spring 42 and the angles of inclination of the cam surfaces 150 and 152, relative to the plane of the platform underside 138, substantially determines the magnitude of the torque producing force. It is desirable to arrange the slope of the cam surface 150 and 152 and the load rate of the spring 42 to provide a torque producing force of sufficient magnitude to restore the razor blade assembly 5 to its initial position without substantial interference with pivotal motion during shaving.

Figure 14:
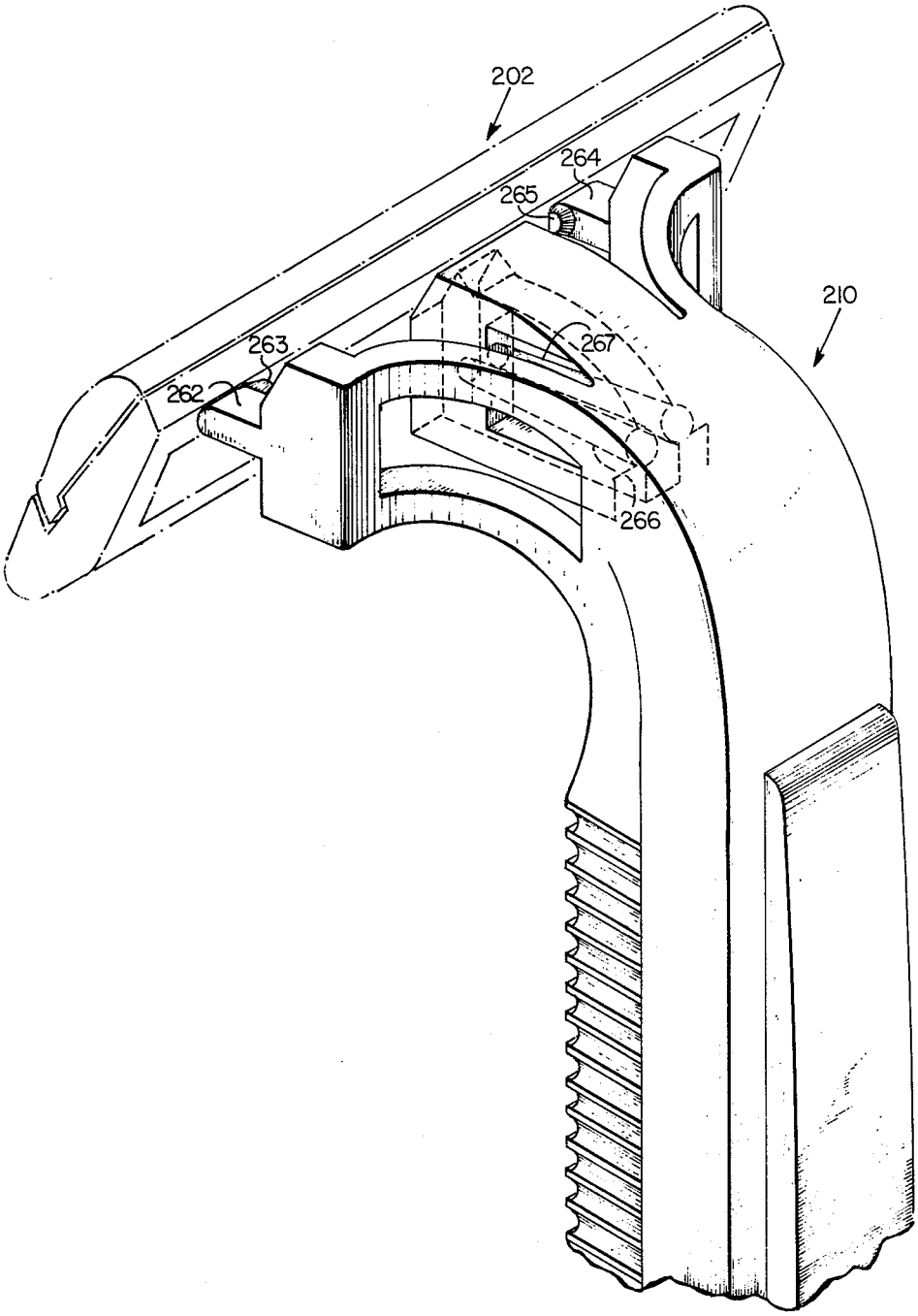
FIG. 14 is a perspective view of the razor handle assembly, shown in FIG. 8.

Referring to FIGS. 8 and 14, there are shown perspective views, partially cut-away, of an alternative embodiment of a razor blade assembly 202 attached to an alternative embodiment of a razor handle 210. The razor blade assembly 202 has a substantially rigid platform member 206, a cap member 108, and blade means 110. One or more blade members 112 and a spacer member 14 disposed between the platform member 206 and the cap member 108, may comprise the blade means 110, as described above with reference to FIG. 6. In the razor blade assembly 202, the platform member 206 is provided with support member 240 and 244 and a cam member 242 molded integrally with the platform member 206. The support members 240 and 244 and the cam member 242 extend from a platform underside 238 and are located intermediate shaving unit ends 203 and 205. Apertures 241 and 245 in the support members 240 and 244 provide journal bearings for opposing journals 263 and 265 disposed on arms 262 and 264 on the razor handle 210. The arms 262 and 264 are molded integrally with the razor handle assembly 210 and are formed from rigid material, having a degree of flexibility, such as plastic, so that in manufacture the journal 263 may be moved into the aperture 241 and the journal 265 may be moved into the aperture 245 by flexing of the arms 262, 264.

The cam member 242 has a plurality of cam surfaces 247, as shown in FIG. 9, and 249, as shown in FIG. 10. The cam surface 247 is formed by oppositely inclined surfaces 251 and 253 which intersect to form a dihedral angle with an apex 255. The cam surface 249 is formed by oppositely inclined surfaces 257 and 259 which intersect to form a dihedral angle with an apex 261. The journal bearing 241 and 245 have axes aligned with each other to provide a pivot axis 361 (FIG. 8) located above the apex 261 and the apex 255. Thus, the pivot axis 361 is closer to the platform underside 238 than either the apex 255 or the apex 261.

The razor handle assembly 210 has, in addition to the opposing journals 263 and 265, a cam follower assembly comprising first and second cam follower members 266 and 267 in the form of flexible rods, formed from material such as plastic, and molded integrally with the razor handle assembly 210. The razor blade assembly 212 is attached to the razor 210 by inserting the journals 263 and 265 into the journal bearings 241 and 245 and arranging the cam member 242 to engage both the cam follower members 266 and 267, as shown in FIGS. 11, 12 and 13. The cam member 242 normally engages the cam follower member 266 at the apex 255 and the cam follower member 267 at the apex 261, as shown in FIG. 12. The cam member 242 and the cam follower members, 266 and 267, cooperatively urge the blade means 110 in the razor blade assembly 202 to be in a plane at a desired angular attitude, $\phi$, relative to razor longitudinal axis 271.

Examples of a razor handle assembly comprising a pair of arms and a cam follower assembly cooperatively coupled to a razor blade assembly have been disclosed. Numerous and varied other arrangements can readily be devised in accordance with the disclosed principles.

What is claimed as new and desired to be secured by Letters Patent of the United States is:

1. A razor handle for a razor blade assembly adapted to be movably mounted on said handle and having cam means thereon for receiving a biasing force, said razor handle comprising:

journal means disposed on movable arm portions of said razor handle, said arm portions being pivotally movable toward and away from each other to permit said journal means to engage and disengage said razor blade assembly; and cam follower means projecting from an opening in said handle and moving reciprocally through said opening in response to a force applied to a free end thereof by movement of said razor blade assembly, whereby to exert a yieldable biasing force on said razor blade assembly.

2. A razor handle adapted to receive a razor blade assembly for pivotal movement thereon, said razor blade assembly having cam means for receiving a biasing force, said razor handle comprising:

pivot mounting means disposed on movable arm portions of said razor handle for receiving said razor blade assembly; and cam follower means projecting from an opening in said handle and moving reciprocally through said opening in response to a force applied to a free end thereof by movement of said razor blade assembly, said cam follower means being operable to move said arm portions and thereby said pivot mounting means for engagement with said razor blade assembly.

3. A razor handle according to claim 2 and including a pusher means operable to pivotally move said arm portions and thereby said pivot mounting means in directions away from each other, thereby to disengage from said razor blade assembly.

4. A razor handle according to claim 3, and including a locking means connected to said pusher means and adapted to lock said arm portions and thereby said pivot mounting means in an open position.

5. A razor handle comprising:

a housing having an opening therein and a wall portion with first and second pivot means disposed thereon;

a first arm having pivot means thereon complemental to said housing first pivot means and engaged therewith for pivotal movement of said first arm, said first arm having a first mounting means thereon for receiving a first portion of a razor blade assembly;

a second arm having pivot means thereon complemental to said housing second pivot means and engaged therewith for pivotal movement of said second arm, said second arm having a second mounting means thereon for receiving a second portion of said razor blade assembly; and cam follower means disposed in said housing and comprising a substantially rigid member which is spring biased to project from said opening and to move reciprocally in response to force applied thereto;

said cam follower means being operable to initiate movement of said first and second arms about said first and second pivot means to move said first and second mounting means to engage said first and second portions of said razor blade assembly.

6. A razor handle comprising:

a housing having an opening therein and having first and second pivot means;

a first arm mounted on said first pivot means and adapted to receive a first portion of a razor blade assembly, a second arm mounted on said second pivot means, and adapted to receive a second portion of a razor blade assembly, and cam follower means disposed within said housing and comprising a substantially rigid spring biased member projecting from said opening and being reciprocally movable in response to a force applied to a free thereof by movement of said razor blade assembly, whereby to exert a yieldable biasing force on said razor blade assembly.

7. A razor handle comprising:

a housing having first and second pivot means;

a first arm mounted on said first pivot means and adapted to engage a first portion of a razor blade assembly;

a second arm mounted on said second pivot means and adapted to engage a second portion of said razor blade assembly;

cam follower means extending from said housing and being movable in response to a force applied thereto by pivotal movement of said razor blade assembly on said first and second arms; and a pusher means disposed on said housing and operatively connected to said first and second arms, said pusher means, upon actuation thereof by an operator, effecting movement of said first arm upon said first pivot means in a direction away from said second arm and effecting movement of said second arm upon said second pivot means in a direction away from said first arm, whereby to release said blade assembly.

* * * * *